United States Patent [19]

Utter

[11] 4,431,380

[45] Feb. 14, 1984

[54] SCROLL COMPRESSOR WITH CONTROLLED SUCTION UNLOADING USING COUPLING MEANS

[75] Inventor: Robert E. Utter, Genoa, Wis.

[73] Assignee: The Trane Company, La Crosse, Wis.

[21] Appl. No.: 385,618

[22] Filed: Jun. 7, 1982

[51] Int. Cl.[3] ..... F04B 49/02; F04B 39/08; F04C 18/02; F04C 29/08

[52] U.S. Cl. ..... 417/286; 417/295; 417/300; 417/505; 418/55; 418/59; 464/82

[58] Field of Search ..... 418/55, 59; 417/295, 417/505; 464/81, 82, 102

[56] References Cited

U.S. PATENT DOCUMENTS

| | | | |
|---|---|---|---|
| 1,591,063 | 7/1926 | Smith | 464/81 |
| 3,884,599 | 5/1975 | Young et al. | 418/55 |
| 4,157,234 | 6/1979 | Weaver et al. | 418/59 |
| 4,191,032 | 3/1980 | August | 464/82 |
| 4,353,682 | 10/1982 | Linnert et al. | 417/295 |
| 4,383,805 | 5/1983 | Teegarden et al. | 418/55 |

*Primary Examiner*—John J. Vrablik
*Assistant Examiner*—Theodore Olds
*Attorney, Agent, or Firm*—Carl M. Lewis; Ronald M. Anderson; Raymond W. Campbell

[57] ABSTRACT

In a scroll compressor, means for maintaining the motion of an orbiting plate in fixed angular relationship to a stationary plate and for modulating the capacity of the compressor. The orbiting and stationary plates include intermeshed wrap elements of similar spiral shape about an axis. A coupling ring is slideably disposed between the plates and sealingly encloses the wrap elements. Four slots are provided in the coupling ring, aligned at right angles to each other and spaced apart around its inner circumference. Three segments, extending outward from the wrap elements, sealingly engage these slots. The fourth slot is engaged by a sliding key attached to one of the plates. The segments separate a first and a second fluid inlet and cooperate with the slots in the coupling ring to constrain the orbiting plate's motion in fixed angular relationship to the stationary plate. Valves on the first and second inlets are provided to control the flow of fluid to be compressed into the separate inlet volumes defined by the segments, thereby modulating the compressor's capacity.

10 Claims, 5 Drawing Figures

SCROLL COMPRESSOR WITH CONTROLLED SUCTION UNLOADING USING COUPLING MEANS

DESCRIPTION

1. Technical Field

This invention generally pertains to a positive displacement compressor of the scroll type, and specifically to means for coupling the fixed and orbiting scroll plates in such a compressor and modulating its capacity by suction unloading.

2. Background Art

Positive displacement fluid compressors of the scroll type typically include parallel orbiting and fixed plates having intermeshed involute wrap elements attached. The axes of the wrap elements are normally parallel and offset so that the relative orbital motion of the wrap elements causes pockets of fluid defined by the flank surfaces of the wrap elements to move inward towards a center discharge port. Fluid trapped in these pockets experiences a decrease in volume and an increase in pressure.

The axial offset between the wrap elements and the angular relationship between the orbiting and fixed wrap element determine the configuration and number of fluid pockets. A change in these parameters during operation of the compressor can cause a pocket to open, reducing the compressor's efficiency. The angular relationship between the wrap elements should thus be constant to insure that they remain in contact at a minimum of two points. A coupling mechanism is thus required which allows one of the scroll plates to move in a circular orbit, while preventing its rotation relative to the stationary plate.

Designs for such mechanisms are well known in the prior art. For example, FIG. 2 of U.S. Pat. No. 4,314,796 discloses a sliding block within a sliding rectangular member for coupling a drive shaft to a nonrotating orbiting scroll plate. An annular ring coupling member is disclosed in U.S. Pat. No. 3,294,977, of the type commonly referred to as an "Oldham coupling". The annular ring is disposed between an orbiting plate and a stationary framework, and includes four sliding keys arranged at 90° intervals on alterante sides of the ring, which engage corresponding slots in the plate and frame. Variations of this design place the sliding keys on the frame and on the back of the orbiting scroll plate, and slots on the ring; or alternatively, the coupling ring may be disposed between the orbiting and stationary scroll plates.

A further aspect of this invention involves modulating the capacity of a scroll compressor. It is frequently desirable to modulate compressor capacity to reduce cycling and to save energy. For example, in a refrigeration system application, a reduction in cooling demand may be met either by repetitively starting and stopping the compressor, or by unloading it so that its capacity equals the demand. Since rapid cycling of a compressor is likely to reduce its operating life, it is preferable to modulate the compressor capacity in an energy efficient manner.

One method for modulating the capacity of a scroll compressor is to block fluid flow to a fluid pocket being formed at the radially outer ends of the spiral wrap elements. Typically, the outer ends of both wrap elements are open to the same suction pressure, drawing fluid from inside an hermetic shell or from a common suction port. Therefore, the flow of fluid into the pocket formed at the outer end of each wrap element is not independently controllable. If the flow of suction gas to one or both inlets and the fluid pockets formed adjacent thereto can be separately controlled, the capacity of the scroll compressor can be modulated over a much broader range more efficiently. Moreover, a further advantage will result if the means for separating the inlets also serves as coupling means to constrain the orbiting scroll plate to move in fixed angular relationship to the stationary scroll plate.

It is therefore an object of this invention to provide means to maintain a fixed angular relationship between an orbiting and a stationary scroll plate in a scroll compressor.

An additional object of this invention is to provide efficient means for modulating the capacity of a scroll compressor by controlling the flow of suction fluid into the compressor.

A further object is to modulate the capacity of a scroll compressor over a relatively wide range.

A still further object is to incorporate means for coupling the fixed plate to the stationary plate is a scroll compressor, which are also effective to interrupt fluid communication between the fluid pockets formed at the outer ends of each of the wrap elements.

Yet a still further object is to independently control the flow of suction fluid into inlets at the outer end of each spiral wrap element in a scroll compressor.

These and other objects of the invention will become evident from the description of the preferred embodiment which follows, and by reference to the attached drawings.

DISCLOSURE OF THE INVENTION

The subject invention comprises means for maintaining the motion of an orbiting plate in fixed angular relationship to a stationary plate in a positive displacement fluid compressor of the scroll type. The plates include intermeshed wrap elements of similar sprial shape about an axis.

A coupling ring is slideably disposed between the orbiting and stationary plates. It includes a plurality of slots which are generally aligned at right angles to each other and perpendicular to the axes of the wrap elements.

A plurality of segments protrude outward from the radially outer surface of the wrap elements. Each segment is aligned with one of the slots in the coupling ring and slideably engages it. As the orbting plate is driven in its circular orbit, the segments slide back and forth within the slots so that the orbiting plate is constrained to move in fixed angular relationship to the stationary plate.

The segments separate the volume defined by the radially outer surface of wrap elements, the coupling ring, and the stationary and orbiting plates into at least two sections. A separate section of this volume is in fluid communication with each of the first and second inlets. By providing segments which sealingly engage the slots and which extend between the plates, fluid communication between the first and second inlets is interrupted. Valve means are further provided to control fluid flow into either one or both of the inlets, thereby modulating the capacity of the compressor.

DESCRIPTION OF THE PREFERRED EMBODIMENT

Figure 1:
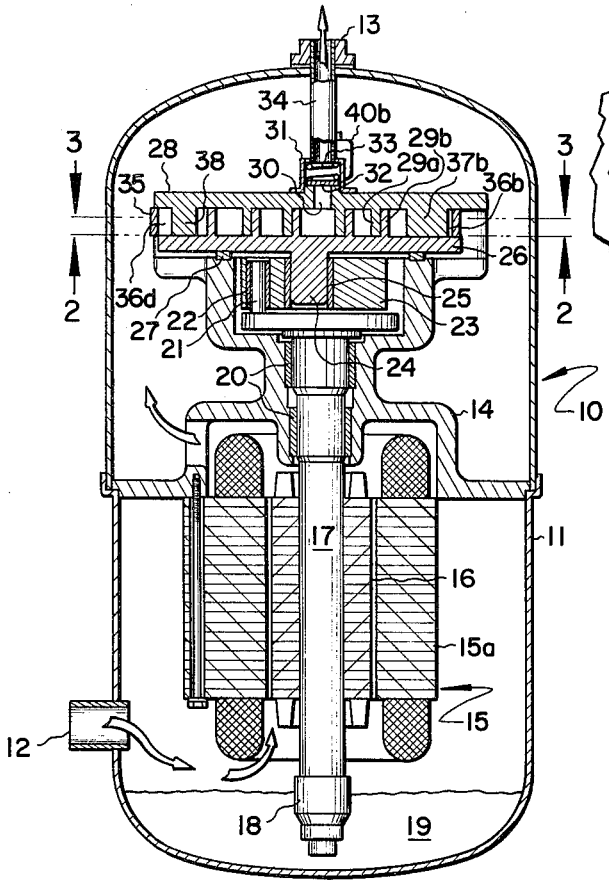
FIG. 1 is a cut-away view of a positive displacement fluid compressor of the scroll type, which uses the subject invention to couple the orbiting scroll plate to the stationary scroll plate and for modulating the capacity of the compressor.

Referring to FIG. 1, a scroll compressor including the subject invention is generally denoted by reference numeral 10. Compressor 10 is enclosed within an hermetic shell 11, which includes in its lower section a suction port 12, and at its top, a discharge port 13. Hermetic shell 11 is welded together, the joint providing support for compressor framework 14. Framework 14 served to axially align the operating mechanism comprising scroll compressor 10 within hermetic shell 11 and generally divides its internal volume into the parts.

Depending from framework 14 is an electric motor 15 of generally conventional design, comprising windings 15*a* and rotor 16. A drive shaft 17 extends through the axial center of rotor 16, and includes on its lower end an oil pump 18 of a centrifugal cone-type, partially submerged in oil reservoir 19. Rotation of the oil pump 18 causes oil to flow upward through interior bores (not shown) in the shaft to lubricate bearing surfaces adjacent thereto, such as bearings 20. Bearings 20 are provided on the upper end of drive shaft 17 and in combination, act both to radially center and to support the drive shaft 17 and rotor 16 within motor 15. Also at its upper end, drive shaft 17 includes a crankpin 21 having its axis generally parallel to, but offset from the axis of drive shaft 17. As drive shaft 17 is rotatably driven by electric motor 15, crankpin 21 pivots in a journal bearing 22, causing a swing link 23 connected thereto, to rotate about its axis. Swing link 23 serves as a radially compliant drive element which engages drive pin 24 within a journal bearing 25. Drive pin 24 depends from the lower surface of an orbiting scroll plate 26. As swing link 23 rotates, drive pin 24 describes a circular orbit about the axis of swing link 23, moving within journal bearing 25. Swing link 23 thus translates the rotational motion of drive shaft 17 into the orbital motion of orbiting scroll plate 26.

Immediately below orbiting scroll plate 26 and affixed to compressor framework 14 is thrust bearing 27. Axial force is transmitted from the compressor framework 14 to the orbiting scroll plate 26 by means of circular thrust bearing 27 which is in sliding contact with scroll plate 26.

A stationary scroll plate 28 is disposed immediately above, parallel to, and in facing relationship to orbiting scroll plate 26. Supporting brackets 28*a*, extend from framework 14 to the periphery of stationary scroll plate 28, and in combination with suitable attachment means, e.g., bolts (not shown) operate to keep the stationary scroll plate 28 in fixed relationship to the framework 14.

Figure 2:
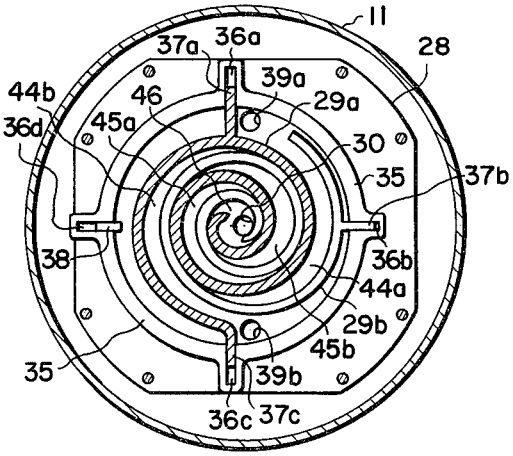
FIG. 2 is a cross-sectional veiw taken along section line 2—2 of FIG. 1.
Figure 3:
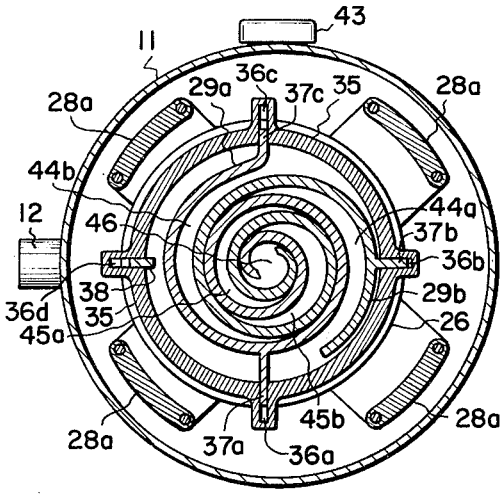
FIG. 3 is a cross-sectional view taken along section line 3—3 of FIG. 1.

As shown in FIGS. 1–3, wrap elements 29*a* and 29*b* of similar spiral shape are attached in intermeshed relationship to the facing surfaces of stationary scroll plate 28 and orbiting scroll plate 26, respectively. It should be apparent that stationary wrap element 29*a* contacts orbiting wrap element 29*b* at various points along their facing flank surfaces, thereby defining pockets in which fluid may be trapped and moved between the facing surfaces of the scroll plates.

Near the center of the stationary scroll plate 28 is a discharge outlet 30, above which is disposed a discharge check valve 31. Check valve 31 comprises a flat valve plate 32 of slightly larger diameter than the discharge outlet 30 and a helical spring 33 which is used to bias the valve plate toward a closed position to seal the discharge outlet 30. Downstream of check valve 31 and connected thereto, conduit 34 is provided to convey compressed fluid through discharge port 13.

Instead of the conventional Oldham coupling typically used in scroll compressors of generally similar design, compressor 10 includes a coupling ring 35 disposed between the stationary scroll plate 28 and orbiting scroll plate 26, and in enclosing relationship to the wrap elements 29. Coupling ring 35 is equal in height to the separation between the facing surfaces of the scroll plates and is in sliding contact with these surfaces in sealing relationship. With reference to FIGS. 2 and 3, it can be seen that four slots 36*a* through *d* are formed at spaced-apart intervals around the internal perimeter of coupling ring 35, being formed with an opening to the volume enclosed thereby, and generally aligned so that adjacent slots 36 lie at right angles to each other. In the preferred embodiment, the slot pairs 36*a*/36*c*, and 36*b*/36*d* are diametrically opposite each other.

Attached to wrap elements 29 and extending into slots 36*a* through *c* are segments 37*a* through *c*, respectively. Segment 37*a* is attached to the outer flank surface of stationary wrap element 29*a* and is aligned with slot 36*a* so that it can slide back and forth therein in sealing contact with the internal surfaces of the slot. Likewise, segment 37*b* extends radially outward from the orbiting scroll element 29*b*, slidingly engaging slot 36*b* and forming a seal with its internal surfaces. The radially outer end of stationary wrap element 29*a* comprises segment 37*c* which is similarly aligned to engage slot 36*c* in sealing relationship. Since segments 37 extend between the facing surfaces of the orbiting scroll plate 26 and stationary scroll plate 28 in sealing contact with the plate opposite the one to which they are attached, they are operative to separate the volume defined by the plates, the radially outer flank surface of wrap elements 29, and the internal perimeter of coupling ring 36, into three sections. A sliding key 38 is attached on the stationary scroll plate 28, in alignment with slot 36*d*, and in sliding engagement therewith. In cooperation with coupling ring 35 and slots 36 formed therein, segments 37 and sliding key 38 are operative to constrain orbiting scroll plate 26 to move in fixed angular relationship to the stationary scroll plate 28 when it is driven by motor 15. Segments 37 and sliding block 38 restrain the orbiting scroll plate 26 from angular displacement while permitting it to undergo circular translation with a variable circular orbiting radius.

Since coupling ring 35 encloses the wrap elements 29, fluid within hermetic shell 11 may enter the pockets formed between the wrap elements 29*a* and 29*b* only through a first inlet 39*a* or a second inlet 39*b*. First inlet 39*a* is disposed in the stationary scroll plate 28, in a sector thereof between segment 37*a* and segment 37*b*; second inlet 39*b* is disposed in a like sector between segment 37*b* and segment 37*c*. Each of inlets 39 are thus in fluid communication with a separate section of the volume enclosed by coupling ring 35.

Figure 5:
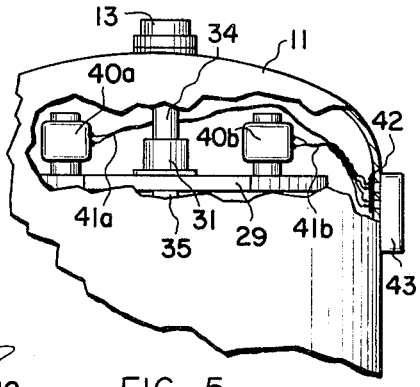
FIG. 5 is a cut-away view of the top of the compressor shown in FIG. 1, rotated clockwise, as viewed from the top of the compressor, through an angle of 90°.
Figure 4:
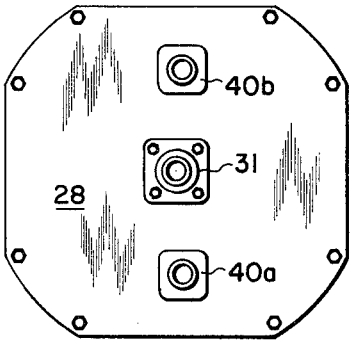
FIG. 4 is a plan view showing the top of the stationary scroll plate.

Attached to first and second inlets 39*a* and 39*b* are first inlet valve 40*a* and second inlet valve 40*b*, respectively, reference FIGS. 4 and 5. Valves 40 are operative to control the flow of suction fluid from the volume enclosed by the hermetic shell 11 through first and second inlets 39*a* and 39*b*, and may comprise electric solenoid valves if it is desired to completely open or close these inlets, or proportional valves if instead, it is desired to modulate the flow of suction fluid over an intermediate range of control. In either case, inlet valves 40 are controlled electrically via leads 41*a* and 41*b* connected to terminals 42 which sealingly extend through hermetic shell 11. Terminals 42 are enclosed in a terminal housing box 43 mounted on the outside of hermetic shell 11.

During operation of compressor 10, fluid enters the hermetic shell 11 through suction port 12, and flows upward through the space between rotor 16 and windings 15*a*, thereby effecting cooling of the motor 15. Suction fluid thereafter enters the upper part of the compressor at a relatively low suction pressure. When compressor 10 is to operate at full capacity, both first and second inlet valves 40*a* and 40*b* are fully opened, allowing fluid to flow through inlets 39*a* and 39*b* into pockets formed between the stationary and orbiting wrap elements 29*a* and 29*b*. The moving line contacts between wrap elements 29 define forming fluid pockets 44*a* and 44*b*, and intermediate fluid pockets 45*a* and 45*b*. As pockets 45*a* and 45*b* move toward the center of the scroll, the volume of the fluid contained therein is substantially decreased and its pressure proportionately increased. These pockets subsequently merge at the center of the scroll forming a common pocket 46 of compressed fluid which exits through discharge outlet 30, if the pressure is sufficiently high for fluid flow through check valve 31.

When the pressure of the fluid in pocket 46 at outlet 30 is greater than the combined force of helical spring 33 and that resulting from the fluid pressure in conduit 34, the fluid pressure unseats the discharge check valve plate 32, thereby allowing fluid to flow out through the conduit 34 to exit compressor 10 through discharge port 13. Otherwise, check valve 31 remains closed.

To modulate the capacity of compressor 10 to 50% of its rated output, either of inlet valves 40*a* or 40*b* may be closed, thereby preventing fluid from entering the associated first or second inlets 39*a* and 39*b*. Suction fluid continues to enter the other inlet with minimal restriction, but is prevented from flowing around the outer flank surface of wrap elements 29, to the closed inlet, by segments 37. Fluid entering the open one of inlets 39 is compressed by the motion of orbital wrap element 29*b* relative to the stationary wrap element 29*a*. Assuming that first inlet valve 40*a* is closed, the pressure within first inlet 39*a* drops to near vacuum level as compressor 10 continues to operate. Under these conditions, intermedite fluid pocket 45*b* contains compressed fluid, and intermediate fluid pocket 45*a* contains fluid at near vacuum pressure. As these pockets of fluid, one at high pressure and the other at near vacuum pressure, move through compressor 10 and continue to combine at the outlet 30 in a common pocket 46, the resultant pressure at outlet 30 initially drops, but then increases with the continuing motion of the orbiting scroll wrap element 29*b* until it slightly exceeds the pressure in conduit 34. Discharge check valve 31 prevents backflow of fluid into outlet 30 from the system to which discharge port 13 is attached. Fluid only flows past the discharge check valve 31 and out through conduit 34 if the system pressure within conduit 34 is less than that at outlet 30. Since outlet 30 receives only 50% of the previously available compressed fluid in each cycle, the mass fluid flow output of compressor 10 is thereby reduced by about 50%.

Compressor 10 may be completely unloaded by closing both first and second inlet valves 40*a* and 40*b*, interrupting suction fluid flow through both inlets 39*a* and 39*b*. The pressure at outlet 30 would subsequently reach an equilibrium pressure, with substantially no fluid flow past the discharge check valve plate 32. If proportional inlet valves 40 are used instead of on/off solenoid valves, the capacity of compressor 10 may be modulated to intermediate values between 0 and 100% of its rated output capacity. If both first and second inlet valves 40*a* and 40*b* are partially closed, fluid flow through both first and second inlets 39*a* and 39*b* is partially restricted, and the mass fluid flow through the compressor 10 is reduced accordingly. Alternatively, one of the inlet valves 40 may be partially closed, and the other inlet valve left open to control capacity to an intermediate value within the range of 50 to 100% rated output.

If capacity control of only one of the inlets 39 on compressor 10 is sufficient for a particular application, it is necessary to provide only one of the first and second inlet valves 39; however, a single valve can only modulate the capacity of compressor 10 in the range of about 50 to 100% of its rated full output. A further modification of the design disclosed hereinabove would use segments 37*b* and 37*c*, but eliminate segment 37*a*. In place of segment 37*a*, a sliding key similar to sliding key 38 would be provided, attached to orbiting scroll plate 26, and aligned to slidingly engage slot 36*a*. Likewise, modifications involving other placements of segments 37 relative to the point where they protrude from the wrap elements 29 are possible, the only constraint being that the slots 36 and their aligned segments 37 and sliding key(s) 38 be aligned so that adjacent slots lie at right angles to each other, and alternate slots lie parallel to each other.

It is also contemplated that compressor 10 might be built without capacity modulation, wherein coupling ring 35 would include slots 37 engaging segments 36 in non-sealing relationship. This would still provide the advantage of maintaining the orbiting scroll plate 26 in fixed angular relationship to the stationary scroll plate 28, to eliminate the use of a conventional "Oldham coupling".

Although the invention is described with respect to several preferred embodiments, further modifications thereto will become apparent to those skilled in the art upon consideration thereof. The scope of the invention is therefore to be determined by reference to the claims which follow.

I claim:

1. In a positive displacement fluid compressor of the scroll type, including two plates with intermeshed wrap elements of similar spiral shape about an axis, means both for maintaining relative orbital motion of the two plates in fixed angular relationship, and for separating two or more fluid inlet chambers disposed between the plates, to prevent fluid communication between the inlet chambers comprising a coupling ring slidingly disposed between the two plates in sealing relationship therewith, said coupling ring including a plurality of radially oriented slots, extending fully between the plates and generally aligned at right angles to each other; and a plurality of segments protruding outward from the radially outer surface of the wrap elements, each segment aligned with one of the slots in the coupling ring and slidingly engaging said slot in sealing relationship, said segments sliding back and forth within the slots to constrain the plates to orbit relative to each other in a fixed angular relationship, said segments being further operative to sealingly separate the fluid inlet chambers from each other.

2. The positive displacement fluid compressor of claim 1 further comprising two or more fluid inlets, each in fluid communication with one of the fluid inlet chambers.

3. The positive displacement fluid compressor of claim 2 further comprising valve means for controlling the flow of fluid to be compressed into one or more of the fluid inlets, and thereby operative to modulate the capacity of the compressor.

4. The positive displacement fluid compressor of claim 3 wherein the valve means comprise one or more solenoid valves.

5. In a positive displacement fluid compressor of the scroll type including two generally parallel plates, one orbiting and the other stationary, the facing surface of each having an involute wrap element attached thereon in intermeshed relationship with the wrap element of the other, said wrap elements each defining a radially inner and a radially outer flank surface of similar spiral shape about an axis, contacting flank surfaces of the intermeshed wrap elements and plates defining one or more pockets of fluid admitted to the volume between the plates through a first and a second inlet and compressed by the relative orbital motion of the plates, means both for coupling the motion of the one plate in fixed angular relationship to the other and for preventing fluid flowing through one of the first and second inlets from mixing with fluid flowing through the other inlet comprising: a coupling ring slideably disposed between the two parallel plates and sealingly enclosing the involute wrap elements, said coupling ring including a plurality of slots disposed in its radially inner surface such that adjacent ones of the slots are aligned at right angles to each other, said slots extending fully between the orbiting and stationary scroll plates; and a plurality of segments extending into the slots from the radially outer flank surface of the involute wrap elements or from the end thereof and substantially equal in height thereto said segments being aligned with and slideably engaging said slots between the plates in sealing relationship so that the orbiting plate slides across the coupling ring transverse to the direction which the coupling ring slides across the stationary plate, thereby maintaining a fixed angular relationship between the stationary and orbiting plates; said segments in conjunction with the radially outer surface of the wrap elements, the facing surfaces of the plates, and the radially inner surface of the coupling ring defining separate inlet chambers in fluid communication with the first and second fluid inlets, respectively, and operative to prevent fluid communication between said chambers around the radially outer surface of the wrap elements.

6. In a positive displacement fluid compressor of the scroll type including two generally parallel plates, one orbiting and the other stationary, the facing surface of each having an involute wrap element attached thereon in intermeshed relationship with the wrap element of the other, said wrap elements each defining a radially inner and a radially outer flank surface of similar spiral shape about an axis, contacting flank surfaces of the intermeshed wrap elements and plates defining one or more pockets of fluid admitted to the volume between the plates through a first and a second inlet disposed adjacent the radially outer surface of the wrap elements and compressed by the relative orbital motion of the plates, means both for coupling the motion of the one plate in fixed angular relationship to the other and for preventing fluid flowing through one of the first and second inlets from mixing with fluid flowing through the other inlets, comprising:

a coupling ring slideably disposed between the plates, generally equal in height to the distance by which they are separated, and enclosing the involute wrap elements in sealing relationship; said coupling ring including four radially oriented, enclosed pocket slots disposed within it, adjacent to the outer flank surface of the wrap elements, and aligned so that successive slots are generally perpendicular and alternate slots are generally parallel to each other, said slots being equal in height to the coupling ring; and a plurality of segments extending outward into the slots, one or more disposed on the radially outer flank surface of the wrap elements, and one or more disposed at the tip of the wrap element, each segment being aligned with and slideably engaging one of the slots, such that the segments move back and forth within the slots as the orbiting plate moves, the coupling ring and the orbiting plate moving back and forth together relative to the stationary plate in a first direction at right angles to a second direction in which the orbiting plate moves relative to the coupling ring, thereby constraining the orbiting plate to move in fixed angular relationship to the stationary plate; said segments dividing the volume defined by the radially outer surface of the wrap elements, the radially inner surface of the coupling ring, and the facing surfaces of the plates into two separate inlet chambers in fluid communication with the first and second inlets, respectively, and further operative to prevent fluid communication between said chambers around the radially outer surface of the wrap elements.

7. The positive displacement fluid compressor of claim 5 or 6 further comprising valve means for controlling the flow of fluid to be compressed into one of the first and second inlets, thereby operative to modulate the capacity of the compressor to within the range of 50 to 100% of its full rated output.

8. The positive displacement fluid compressor of claim 7 wherein the valve means is operative to control the flow of fluid to be compressed into both the first and second inlets, and is thereby operative to modulate the capacity of the compressor to within the range 0 to 100% of its full rated output.

9. The positive displacement fluid compressor of claim 7 further comprising a discharge port disposed within the stationary plate at a location adjacent the axis of the wrap element affixed thereon, and a checkvalve in fluid communication with the discharge port, operative to allow compressed fluid to flow out the discharge port while preventing its flow in the opposite direction.

10. The positive displacement fluid compressor of claim 7 further comprising one or more keys, each in the form of a rectangular block attached to one of the stationary and orbiting plates and extending generally between said plates, each of said one or more keys slideably engaging one of the slots.

* * * * *